US010538894B1

(12) United States Patent
Dominguez

(10) Patent No.: US 10,538,894 B1
(45) Date of Patent: Jan. 21, 2020

(54) MIXING DEVICE FOR SILT FINE SOIL

(71) Applicant: Polymer Technologies Worldwide, Inc., Tampa, FL (US)

(72) Inventor: Yamil Dominguez, Tampa, FL (US)

( * ) Notice: Subject to any disclaimer, the term of this patent is extended or adjusted under 35 U.S.C. 154(b) by 0 days.

(21) Appl. No.: 16/052,710

(22) Filed: Aug. 2, 2018

(51) Int. Cl.
*E02D 5/34* (2006.01)
*E02D 37/00* (2006.01)
*B01F 5/04* (2006.01)

(52) U.S. Cl.
CPC ..... *E02D 37/00* (2013.01); *B01F 5/0403* (2013.01); *E02D 5/34* (2013.01); *E02D 2250/0023* (2013.01); *E02D 2300/0014* (2013.01)

(58) Field of Classification Search
CPC ... E02D 37/00; E02D 5/34; E02D 2250/0023; E02D 2300/0014; B01F 5/0403
See application file for complete search history.

(56) References Cited

U.S. PATENT DOCUMENTS 3,742,717 A * 7/1973 Wey ..... E02D 5/42 405/238
4,395,159 A * 7/1983 Karuks ..... B28B 19/0038 138/103
4,623,025 A * 11/1986 Verstraeten ..... E02D 5/62 175/21
5,005,876 A * 4/1991 Fahl ..... F16L 37/20 285/311
5,104,233 A 4/1992 Kojima
5,219,247 A * 6/1993 Gemmi ..... E02D 5/46 405/237
5,256,004 A * 10/1993 Gemmi ..... E02D 5/34 405/237
5,645,375 A * 7/1997 Stephens ..... C04B 28/26 138/98
6,109,836 A * 8/2000 Gritti ..... E02D 3/12 405/266
6,264,402 B1 * 7/2001 Vickars ..... E02D 5/36 405/237
7,004,684 B2 * 2/2006 Fox ..... E02D 5/44 175/263
7,040,802 B2 5/2006 Fuglister
7,112,012 B2 * 9/2006 Whitsett ..... E02D 5/38 405/233
7,748,932 B2 * 7/2010 Lindsey ..... E02D 5/801 405/232
9,790,655 B1 * 10/2017 Dominguez ..... E02D 3/12
2011/0280669 A1 * 11/2011 Moroschan ..... B65D 25/08 405/271

* cited by examiner

*Primary Examiner* — Benjamin F Fiorello
(74) *Attorney, Agent, or Firm* — Sanchelima & Associates, P.A.; Christian Sanchelima; Jesus Sanchelima

(57) ABSTRACT

The present invention is directed to an apparatus for mixing two or more materials underground. The apparatus comprises at least one hose in fluid communication with containers of the materials that are to be mixed. The apparatus further comprises a mixer in which the at least one hose is terminated. The mixer has at least one aperture for receiving the at least one hose. The mixer further defines a mixing chamber in fluid communication with the at least one aperture to receive the materials entering into each aperture through each hose for facilitating mixing thereof in the mixing chamber. The mixer further includes an outlet for discharging the mixture.

13 Claims, 16 Drawing Sheets

MIXING DEVICE FOR SILT FINE SOIL

BACKGROUND OF THE INVENTION

1. Field of the Invention

The present disclosure relates to the field of mixers. In particular, the present disclosure relates to an apparatus to be used for facilitating mixing of materials underground.

2. Description of the Related Art

It is known to reinforce the soil by injection of structurally resistant material that improve the foundation strength of existing structures such as houses and buildings. To achieve this, one method is to introduce raw materials underground, whose reaction provides stability to the soil, thereby increasing the strength of the foundation. Hence, there is need of a mixer to facilitate this underground mixing and reaction between the raw materials or compositions.

Several designs for mixers have been designed in the past. None of them, however, are known to be usable for underground mixing while having a compact and easy to use configuration.

Applicant believes that a related reference corresponds to U.S. Pat. No. 5,104,233 filed by HISAO KOJIMA. The Kojima reference discloses a mixing element that comprises a passage tube through which fluids to be mixed pass and a fluid structure providing a plurality of fluid passage in the interior of the passage tube. However, the Kojima reference fails to disclose any means to facilitate underground mixing of materials.

Another related application is U.S. Pat. No. 7,040,802 filed by ALFRED FÜGLISTER. The Füglister reference discloses static mixer for a high-viscosity flowing fluid, which includes mixing elements which are made as monoliths and sleeve elements in the form of tube pieces by means of which the mixing elements are positioned as well as a housing into which the sleeve elements are inserted together with the mixing elements. However, the Füglister reference fails to disclose any means to facilitate underground mixing of materials.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a mixer for facilitating underground mixing of materials.

It is yet another object of the present invention to provide a mixer for facilitating underground mixing of materials, which has simple configuration.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
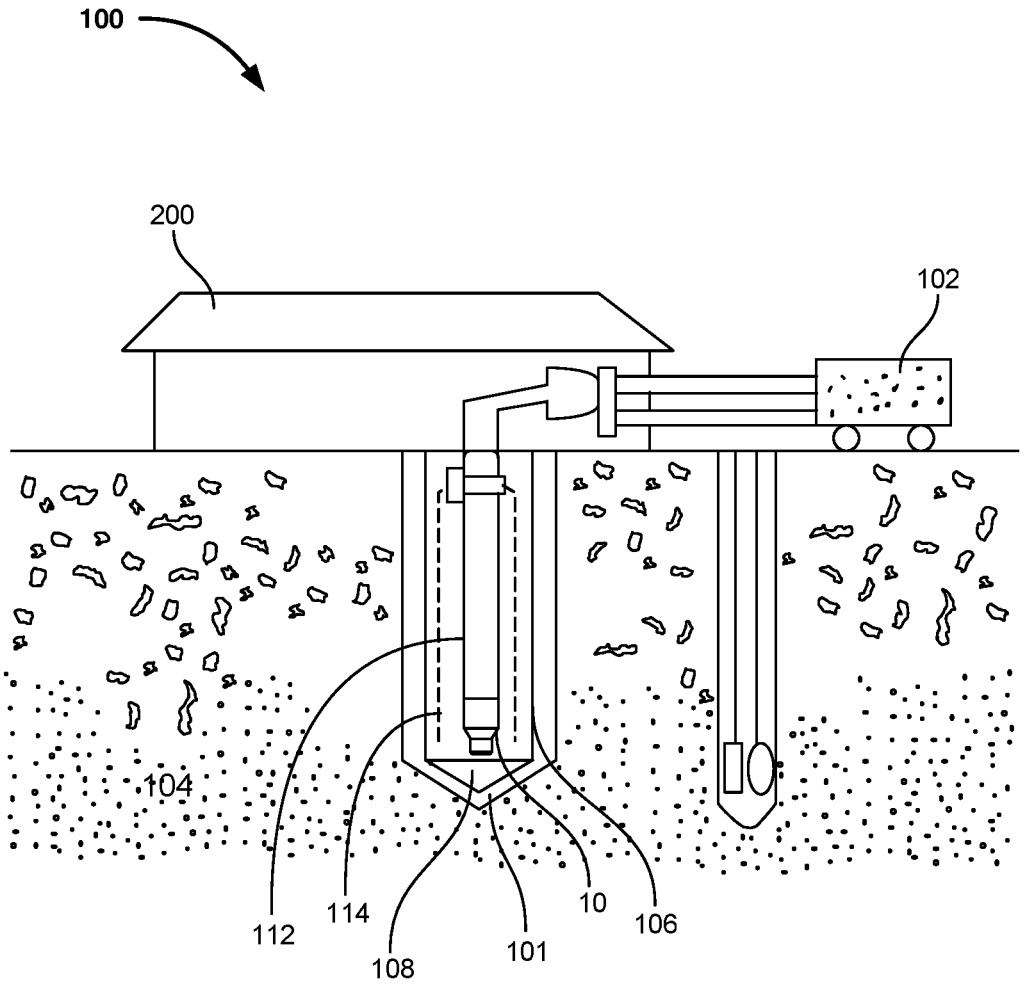
FIG. 1 illustrates a system 100 for improving soil condition, in accordance with one embodiment of the present disclosure. Specifically, cap 108 is shown at a distal end of first pipe 106, both of which have already been inserted a predetermined distance into soil 104, and the composition is injected into the expansion element 114.

Referring now to the drawings, FIGS. 1-13, where the present invention is generally referred to with numeral 10, it can be observed that a mixer 10, in accordance with the present invention, is provided on at the bottom ends of hoses carrying the raw materials or compositions that need to be mixed underground.

FIG. 1 illustrates a system 100 for reinforcing the soil or foundation of the house 200. The system 100 comprises a container 102 containing the composition or the raw material that needs to be mixed into the soil 104 to reinforce the soil and any type of foundation, which includes but not limited to a foundation of the house or any other type of construction. The composition can also be added to the soil to fill voids and thereby stabilizing the soil and associated foundations. The system further comprises a first pipe 106 disposed within a first hole 101 that is drilled in the soil 104. The distal end of the first pipe 106 is covered by means of a cap 108. The system further comprises one or more filler tubes 112 in fluid communication with the container 102. The system further comprises a mixer 10 provided at the operative bottom end of the filler tubes 112 for facilitating the mixing of two or more compositions entering the mixer 10.

Optionally, the system 100 can include an expansion element 114. The mixture of the compositions exiting the mixer 10 is collected inside the expansion element 114. At times, the compositions can be such that upon mixing the compositions in the mixer 10, chemical reaction between the compositions causes the mixture to expand. The expansion can be accommodated by the expansion element 114. After expansion, the mixture can get converted to a hard block, which provides strength to the foundation of the house 200.

Figure 2:
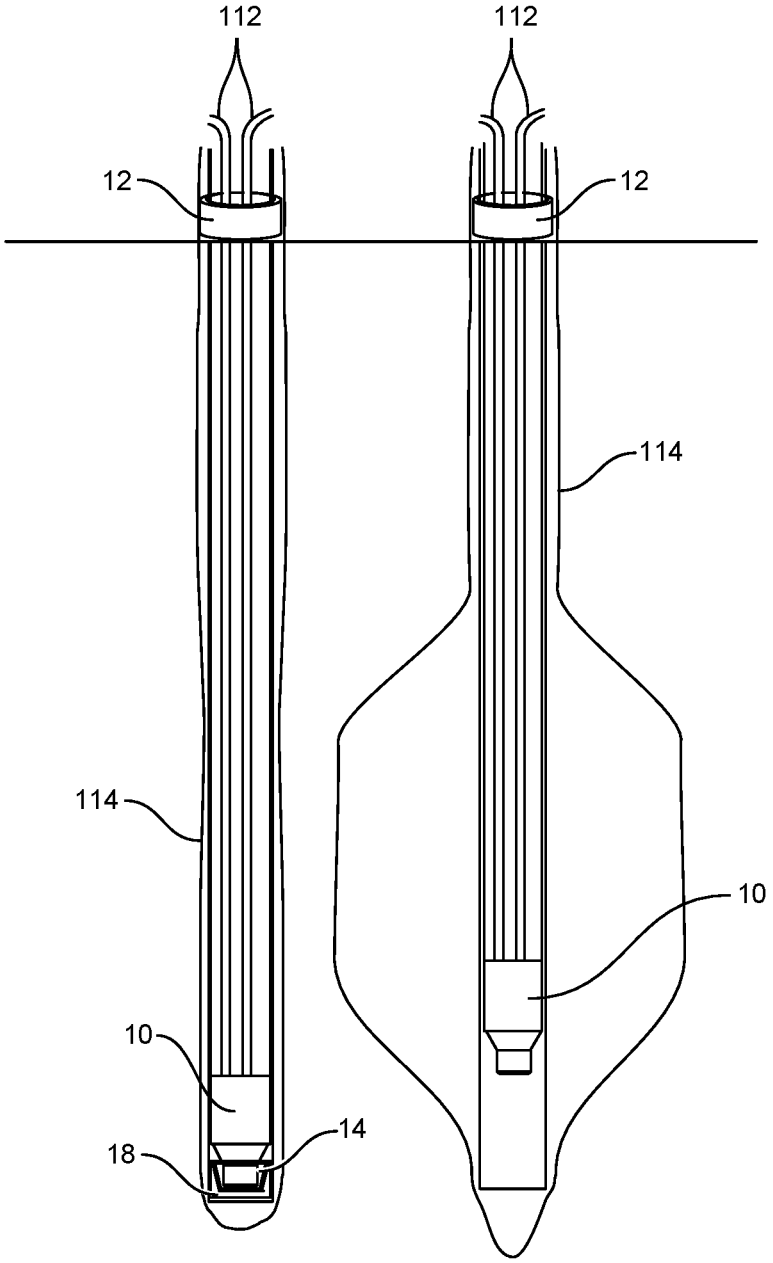
FIG. 2 demonstrates a view of expansion element 114 and filler tubes 112 used to transport the composition underground and towards a mixer 10.
Figure 5:
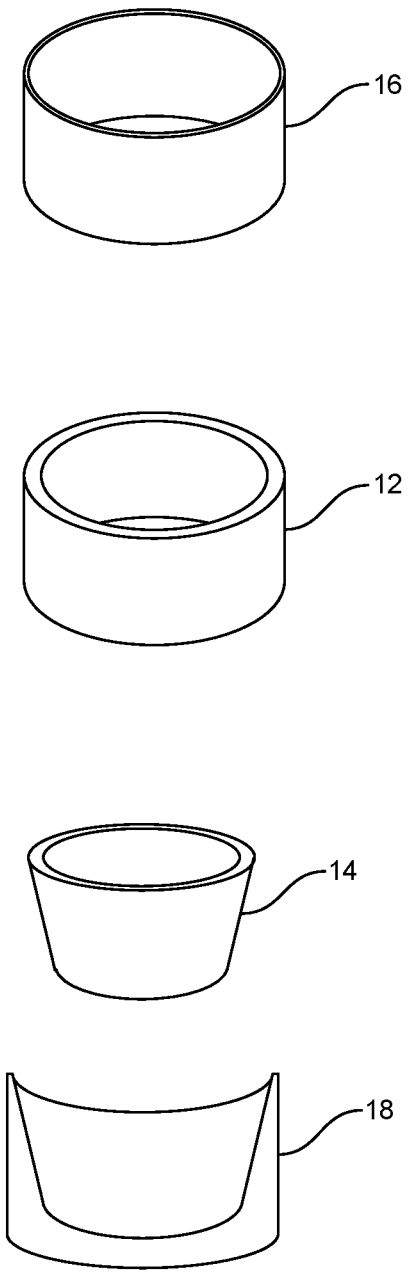
FIG. 5 illustrates the different components that facilitate the proper placement of the filler tubes 112 and the expansion element 114 underground.
Figure 6A:
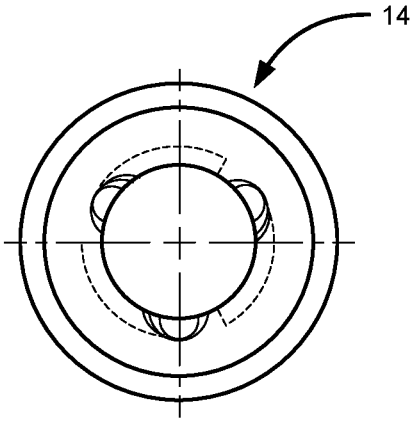
FIG. 6A illustrates a top view of the bottom bushing 14.
Figure 6B:
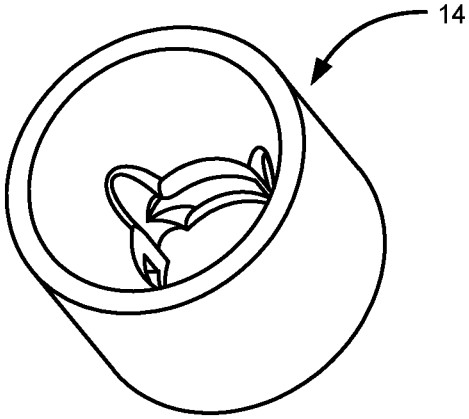
FIG. 6B illustrates an isometric view of the bottom bushing 14.
Figure 6C:
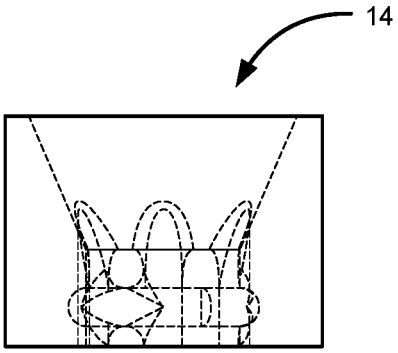
FIG. 6C illustrates a front view of the bottom bushing 14.

Referring to FIG. 2, the ducting as well as the changes in the expansion element 114 can be seen. In the example illustrated in FIG. 2, there are two filler tubes 112 that terminate into the mixer 10. After the formation of the mixture in mixer 10, the mixture is discharged into the expansion element 114, subsequent to which expansion of the mixture occurs in the expansion element 114, as discussed previously. A top bushing 12 allows holding the filler tubes 112 and the expansion element 114 together. A bottom bushing 14 is provided at the operative bottom end of the expansion element 114 for holding the filler tubes 112 and the expansion element 114. FIG. 5 illustrates the different components that facilitate the proper placement of the filler tubes 112 and the expansion element 114 underground, namely, the top bushing 12, the bottom bushing 14, a metallic ring 16 to tie the filler tubes 112 and the expansion element 114 to the top bushing 12, and metallic cover 18 the filler tubes 112 and the expansion element 114 to the bottom bushing 14. FIG. 6A through FIG. 6C illustrate the views of the bottom bushing 14. It is to be noted that the configuration of the bottom bushing illustrated in FIG. 6A through FIG. 6C are only exemplary. Other profiles of the bottom bushing, per the application requirements, are well within the scope of the present invention.

Figure 3A:
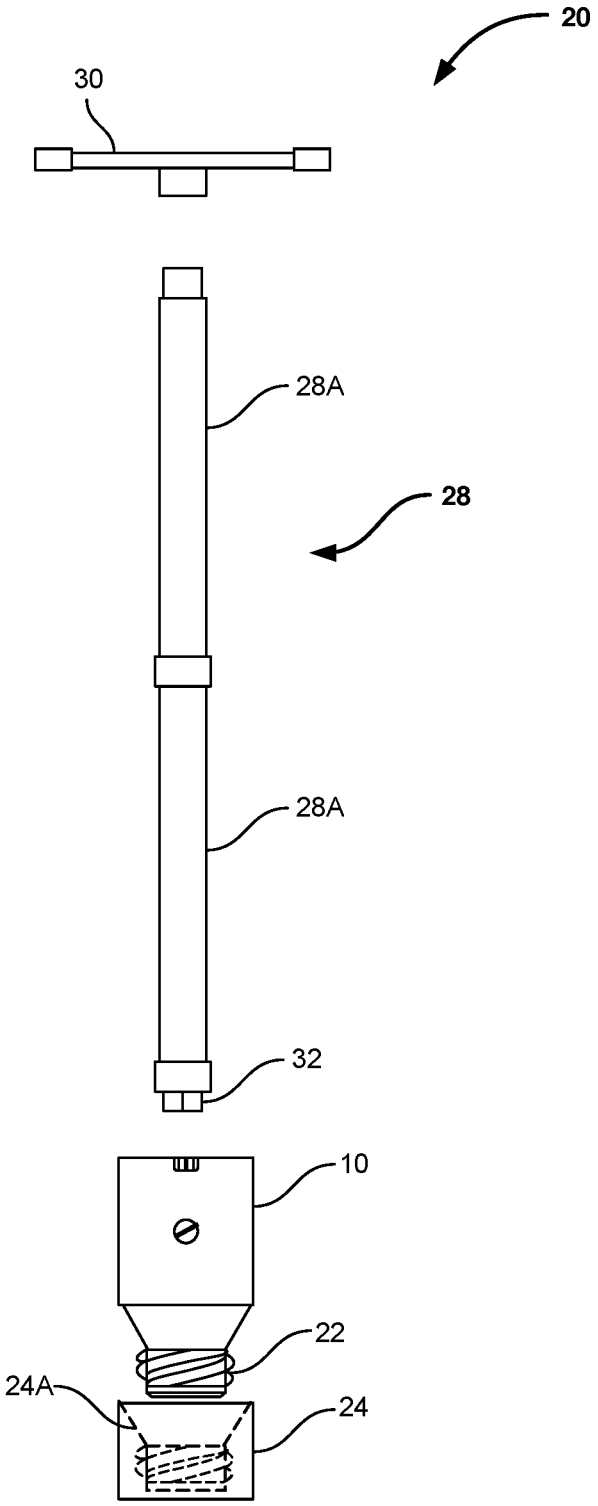
FIG. 3A demonstrates an exploded view of an apparatus 20, for facilitating underground mixing of materials, comprising a base 24 and an extension assembly 28.
Figure 3B:
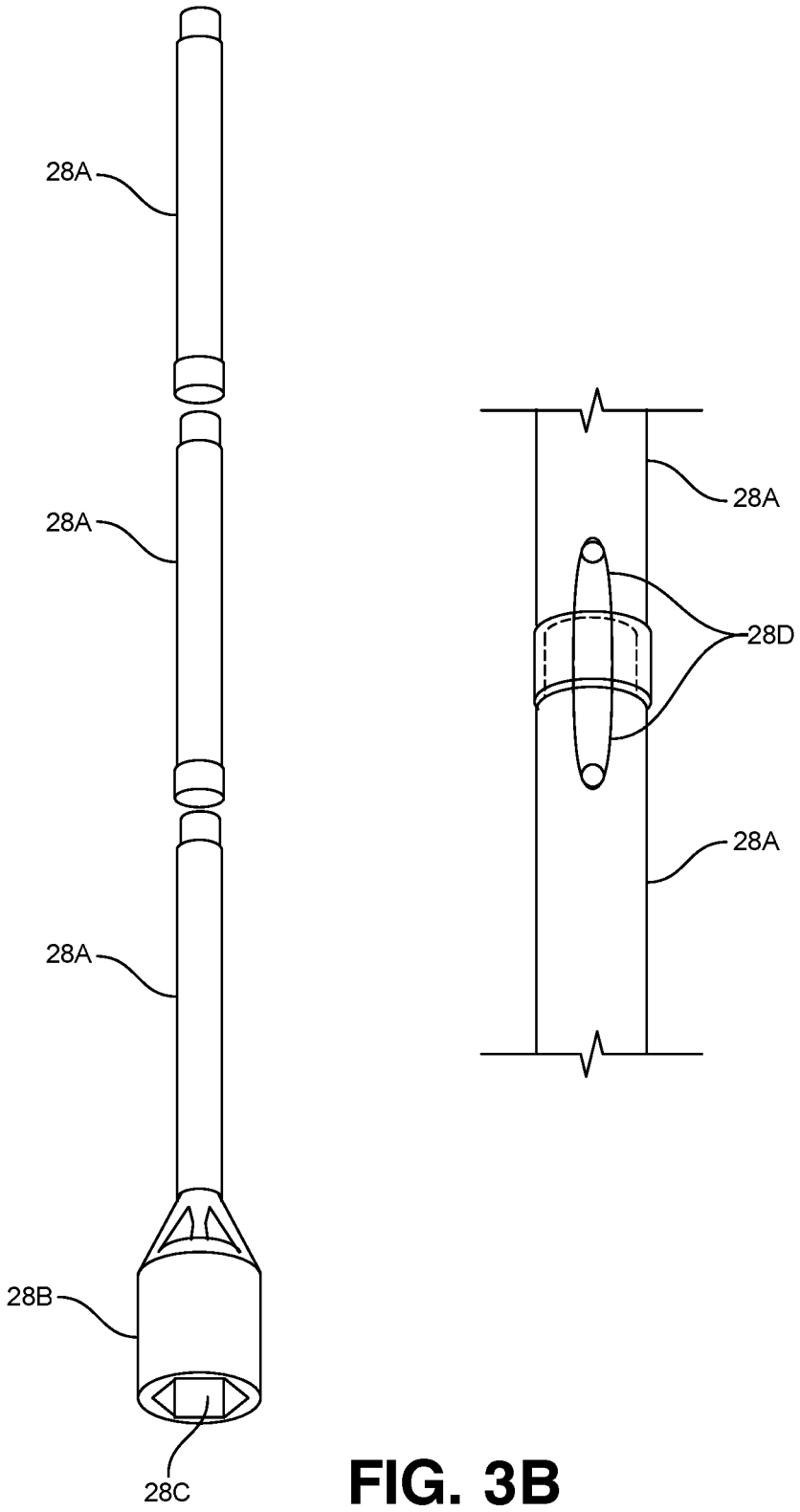
FIG. 3B demonstrates a view of the extension segments 28A of the extension assembly 28 being connectable via loop and clip formations 28D.
Figure 3C:
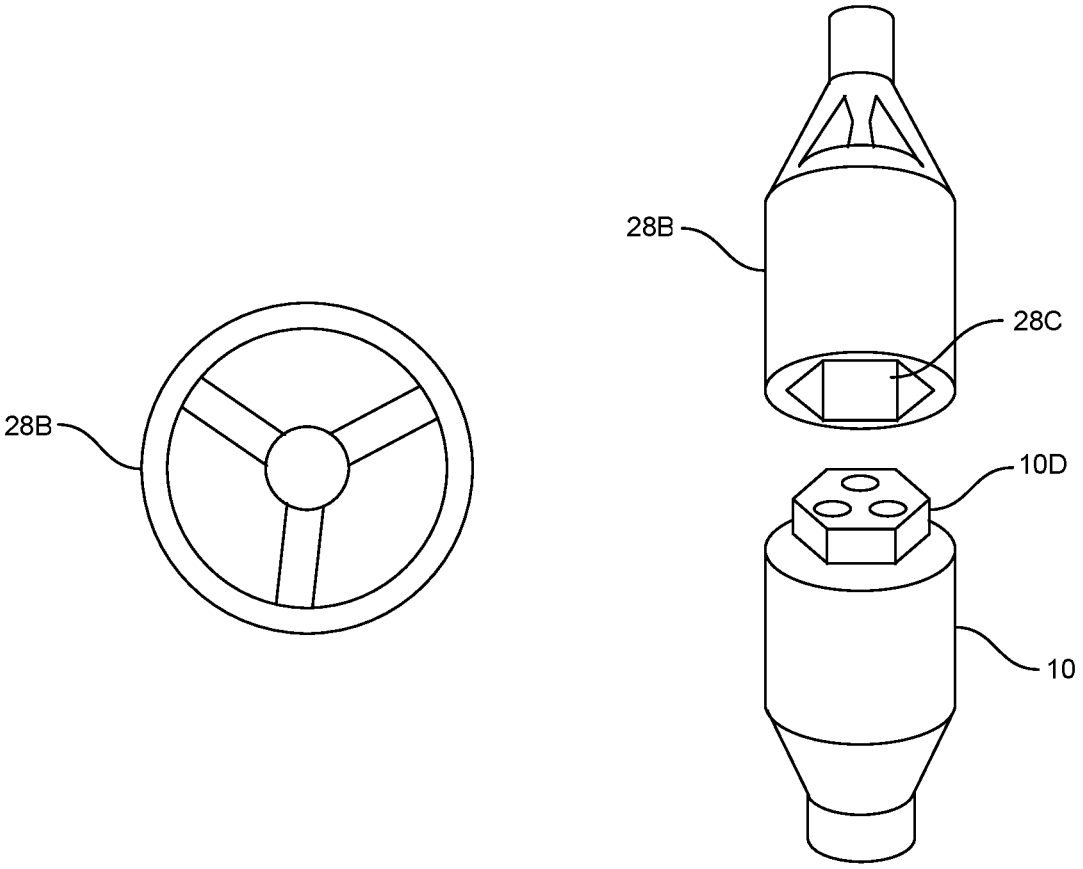
FIG. 3C demonstrates a view of attachment 28B having a hexagonal opening 28C that is connectable to a hexagonal protrusion 10D on the mixer 10.

Referring to FIG. 3A through FIG. 3C, an apparatus 20 for mixing two or more materials underground is seen. The apparatus 20 comprises at least one hose 112 in fluid communication with containers 102 of the materials or compositions that are to be mixed. The apparatus 20 further comprises a mixer 10 in which the at least one hose 112 is terminated. The mixer 10 has at least one aperture 10A for receiving the at least one hose 112. The mixer 10 defines a mixing chamber 18 that is in fluid communication with the at least one aperture 10A to receive the materials entering into each aperture 10A through each hose 112 for facilitating mixing thereof in the mixing chamber 18. The mixer 10 further defines an outlet 22 for discharging the mixture.

The apparatus 20 further comprises base 24 that is configured to be fitted to the outlet 22 of the mixer 10. The base 24 has an opening 24A to securely receive the mixer 10. More specifically, the opening 24A can be provided with threads or other means to securely receive or to fit with the outlet 22 of the mixer 10.

The mixer 10, in accordance with the present invention, has an aperture 26 provided on an operative top surface of the mixer 10. The apparatus 20 further comprises an extension assembly 28. The extension assembly 28 includes a plurality of extension segments 28A, wherein one of the extension segments 28A includes a handle 30, while another one of the extension segments 28A includes a protrusion 32. The extension assembly 28 facilitates the fitment of the mixer 10 onto the base 24. The base 24 is provided at the operative bottom end of the expansion element 114, which is underground. The extension assembly 28 facilitates the maneuvering of the mixer 10 through the first pipe 106 towards the base 24 to facilitate the fitment of the mixer 10 to the base 24. To this end, the handle 30 helps in maneuvering the mixer down the first pipe 106, while the protrusion 32 is configured to mate with the aperture 26 for facilitating the mechanical coupling between the extension segment 28A and the mixer 10 to facilitate the rotation of the mixer 10 when the handle 30 is rotated. In one embodiment, the protrusion 32 and the aperture 26 have a square profile. Other polygonal profiles are also within the ambit of the present invention.

FIG. 3B illustrates an embodiment of the extension assembly 28 wherein instead of the protrusion 32, the extension segment 28A is provided with an attachment 28B defining a hexagonal opening 28C. The hexagonal opening 28C is configured to engage with a hexagonal protrusion 10D provided on the mixer 10, as seen in FIG. 3C. As seen in FIG. 3B, the connection between the extension segments 28A is facilitated by loop and clip formations 28D.

Figure 4:
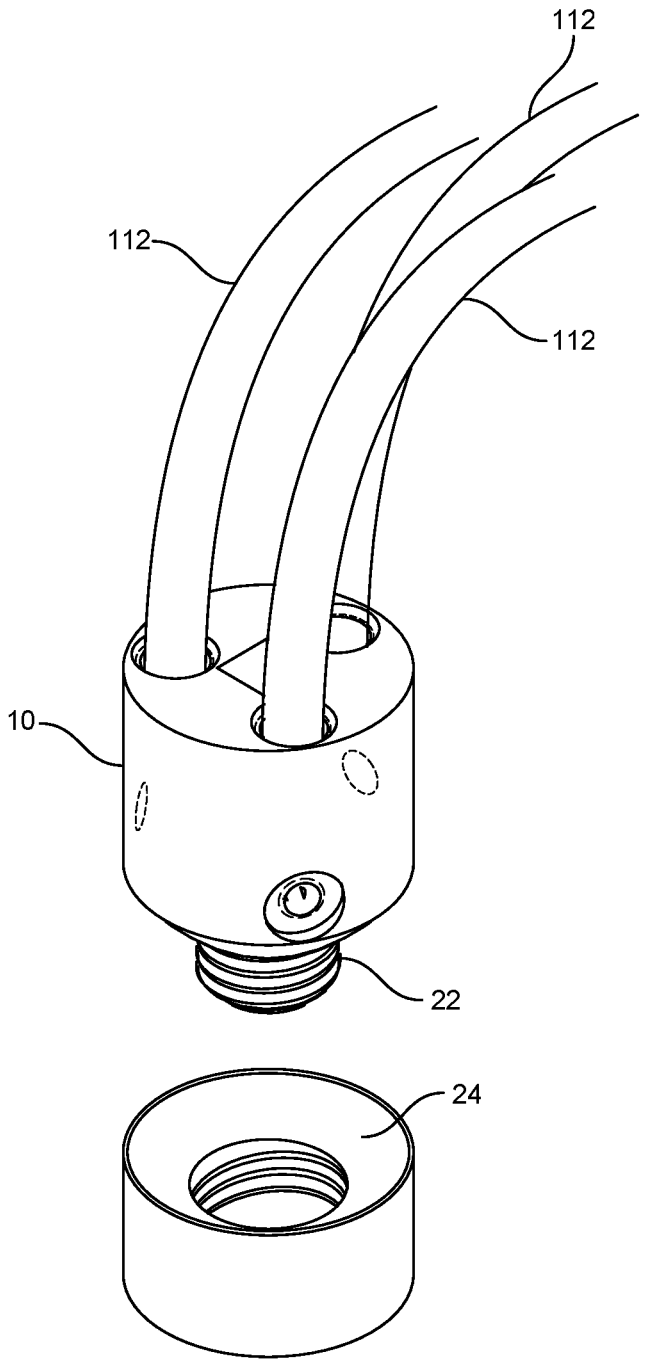
FIG. 4 demonstrates a view of filler tubes 112 being terminated into the mixer 10.

FIG. 4 illustrates an isometric view of the mixer 10 having three filler tubes 112 terminated therewithin. The three filler tubes 112, in accordance with one example, are used to carry a first composition in one of the filler tubes 112, a second composition in another one of the filler tubes 112, and air or water in the third filler tube 112. The base 24 is also shown to have a threaded opening 24A, which is configured to threadably receive the outlet 22 of the mixer 10, which is provided with complementary thread formations.

Figure 7A:
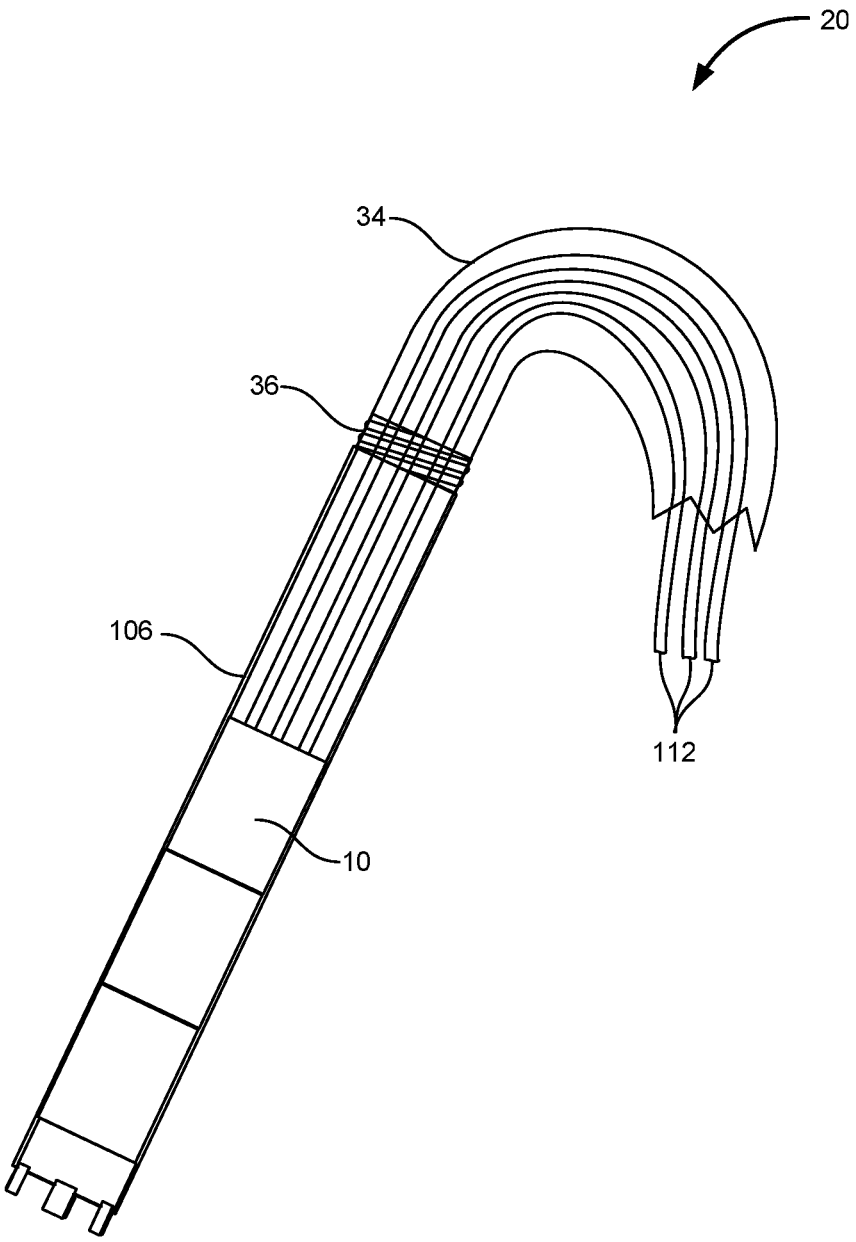
FIG. 7A illustrates a schematic view of flexible hose 34 used to guide the filler tubes in the first pipe 106.

FIG. 7A illustrates the ducting in the apparatus 20. As seen in FIG. 7A, the apparatus 20 comprises a flexible hose 34 that houses the filler tubes 112. Downstream of the flexible hose 34 is the first pipe 106 that houses the filler tubes 112 underground. Drilled cases 36 is used to connect the flexible hose 34 with the first pipe 106 and for holding the filler tubes 112 as well.

Figure 7B:
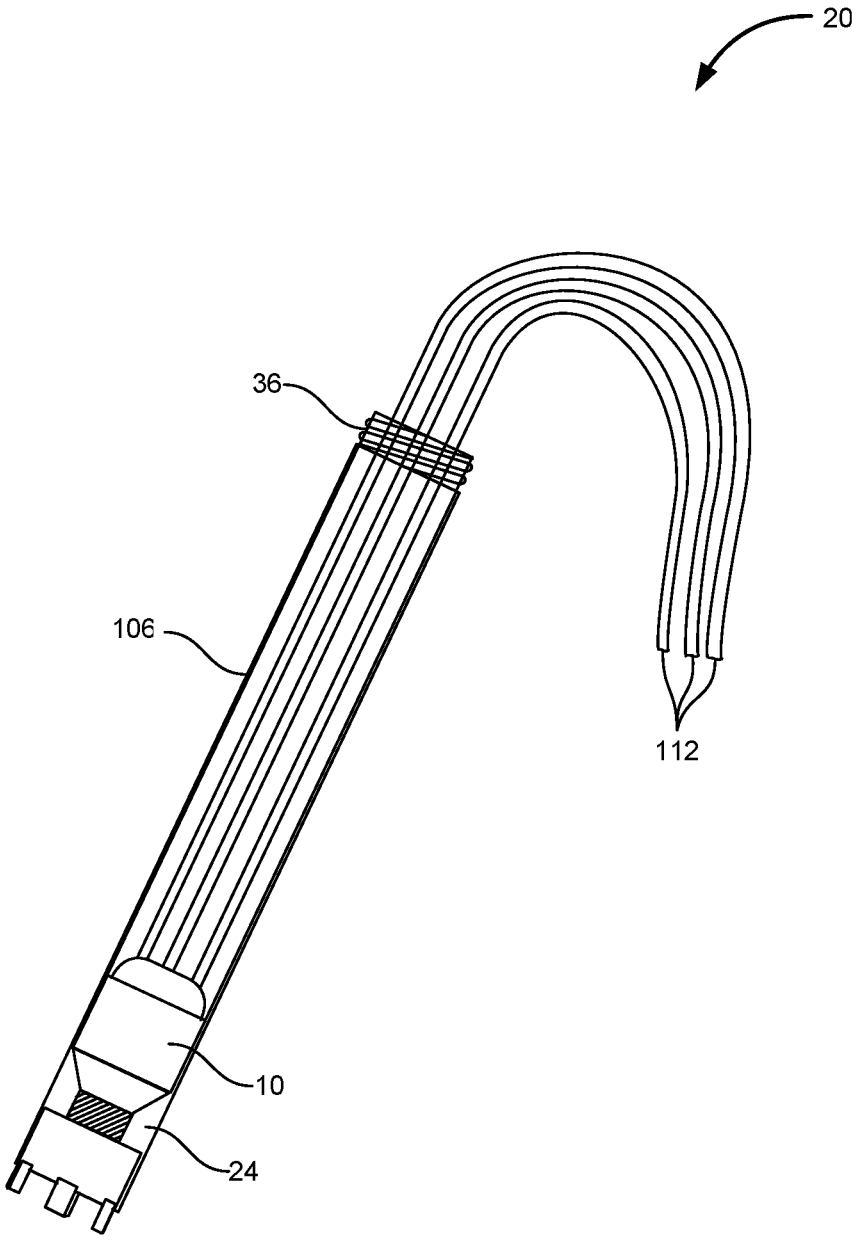
FIG. 7B illustrates a schematic view of the filler tubes 112 being connected to the mixer 10 within the first pipe 106.

FIG. 7B illustrates the ducting in the apparatus 20, as per another embodiment. As seen in FIG. 7B, the apparatus 20 comprises the filler tubes 112 that are inserted into the first pipe 106 such that the filler tubes 112 are terminated into the mixer 10. The flexible hose 34 is absent in this embodiment. Drilled cases 36 is used to connect the flexible hose 34 with the first pipe 106 and for holding the filler tubes 112 as well.

Figure 8A:
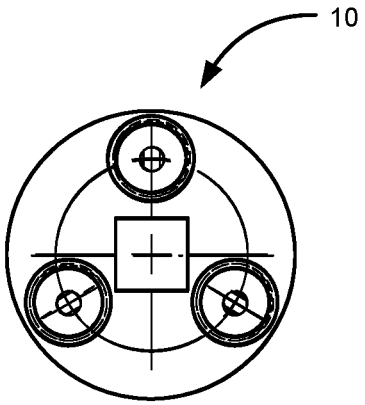
FIG. 8A illustrates a top view of mixer 10, in accordance with one embodiment of the present invention.
Figure 8B:
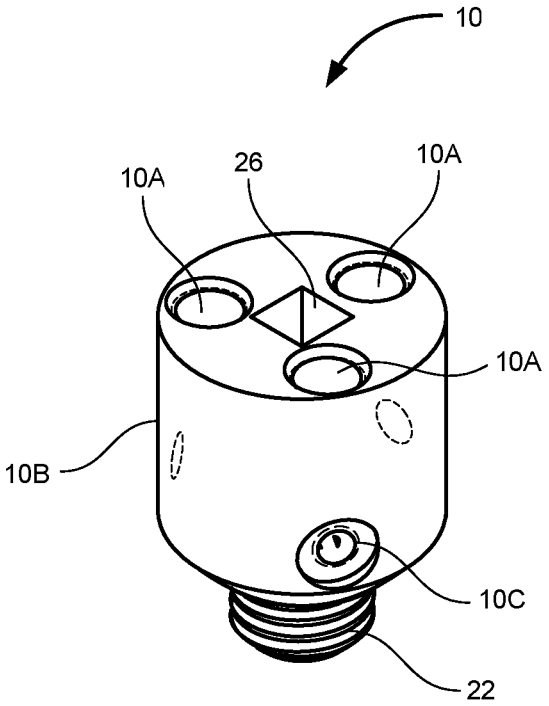
FIG. 8B illustrates an isometric view of mixer 10, in accordance with one embodiment of the present invention.
Figure 8C:
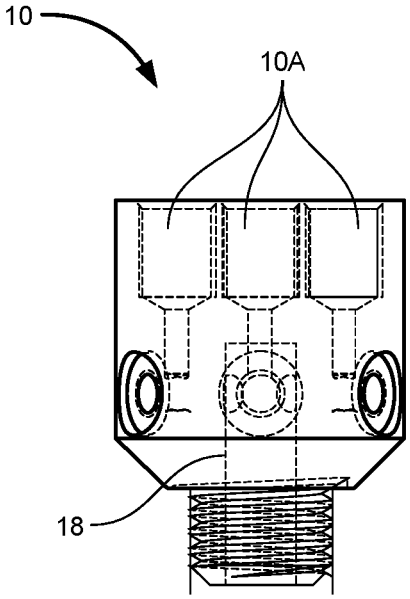
FIG. 8C illustrates a front view of mixer 10, in accordance with one embodiment of the present invention.

FIG. 8A through FIG. 8C illustrate the views of the mixer 10 in accordance with one embodiment of the present invention. The mixer 10 has a cylindrical top portion 10A and the outlet 22 extending downwardly from the top portion 10B. As described previously, the mixer 10 comprises the apertures 10A, 26. The aperture 26 has a square profile in the present embodiment of the mixer 10. The mixer 10 further comprises a hole 10C that facilitates plug or needle location while the mixer 10 is being fitted into another pipe in a concentric arrangement. In the embodiment illustrated in FIG. 8A through FIG. 8C, the outlet 22 is provided with thread formations on the outer surface thereof.

Figure 9A:
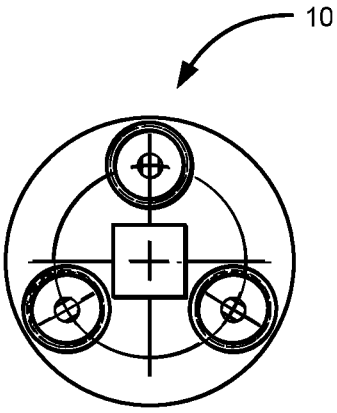
FIG. 9A illustrates a top view of mixer 10, in accordance with another embodiment of the present invention.
Figure 9B:
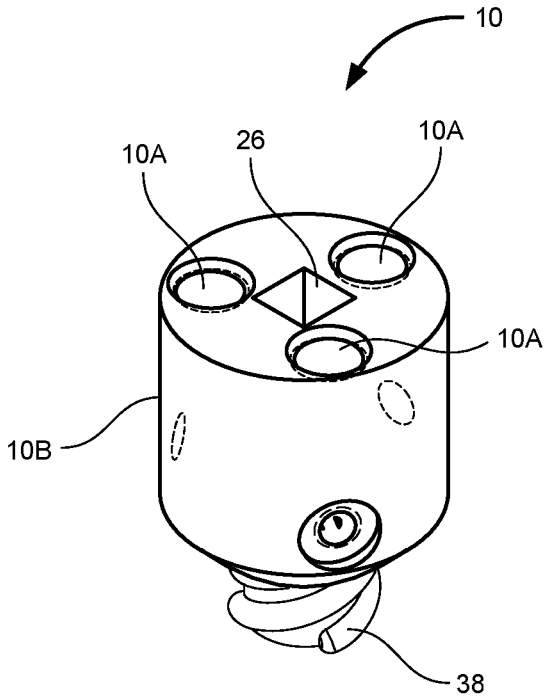
FIG. 9B illustrates an isometric view of mixer 10, in accordance with another embodiment of the present invention.
Figure 9C:
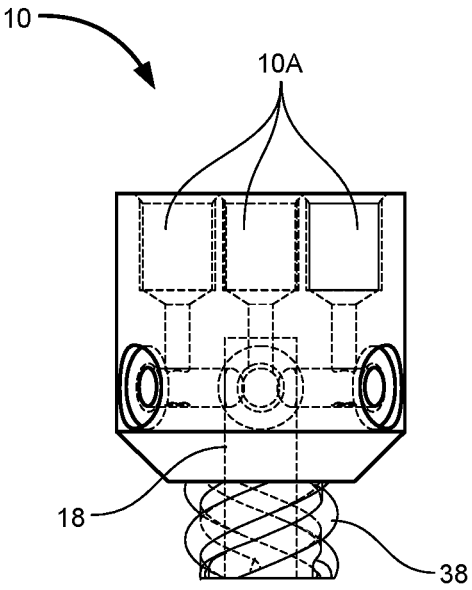
FIG. 9C illustrates a front view of mixer 10, in accordance with another embodiment of the present invention.

FIG. 9A through FIG. 9C illustrate views of the mixer 10 in accordance with another embodiment of the present invention. This embodiment of the mixer illustrated in FIG. 9A through FIG. 9C are similar to the embodiment illustrated in FIG. 8A through FIG. 8C, the only difference being in the formations provided on the outer surface of the outlet 22 of the mixer. As such, the construction of the mixer 10 illustrated in FIG. 9A through FIG. 9C are not described again for the sake of brevity of the present disclosure. Also, like elements in FIG. 8A through FIG. 8C and FIG. 9A through FIG. 9C are referenced by like numerals for the sake of simplicity. The outlet 22 is provided with spiral protrusion 38 provided on the outer surface of the outlet 22.

Figure 10A:
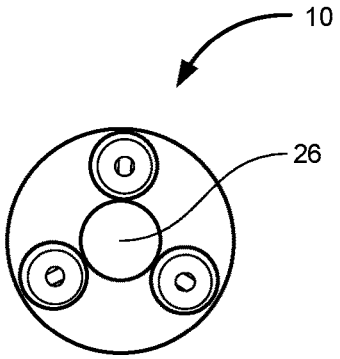
FIG. 10A illustrates a top view of mixer 10, in accordance with yet another embodiment of the present invention.
Figure 10B:
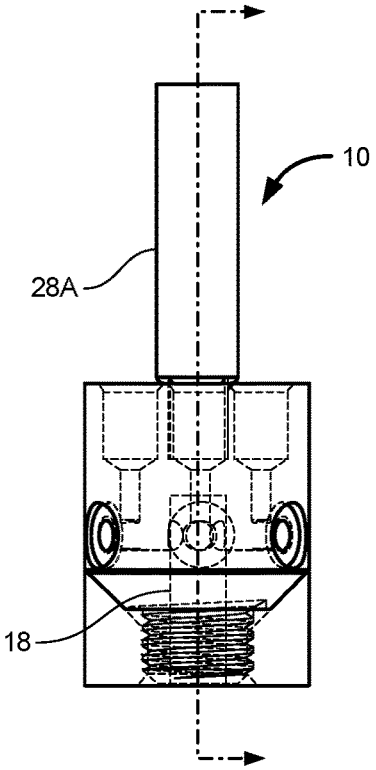
FIG. 10B illustrates a front view of mixer 10, in accordance with yet another embodiment of the present invention.
Figure 10C:
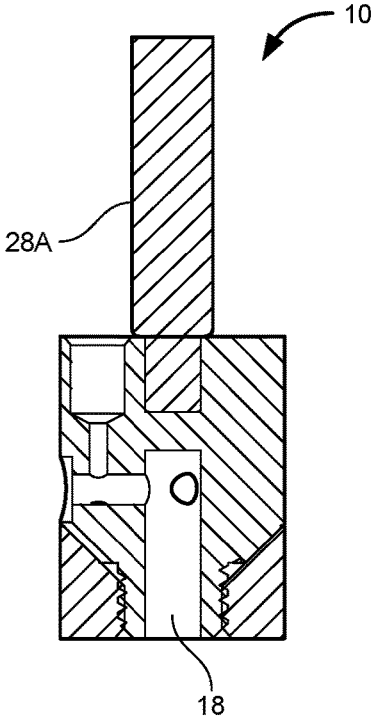
FIG. 10C illustrates a cross-sectional view of mixer 10, in accordance with yet another embodiment of the present invention.
Figure 10D:
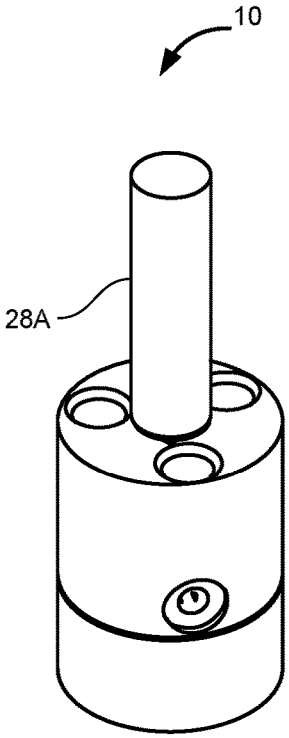
FIG. 10D illustrates an isometric view of mixer 10, in accordance with yet another embodiment of the present invention.

FIG. 10A through FIG. 10D illustrate views of the mixer 10 in accordance with yet another embodiment of the present invention. This embodiment of the mixer illustrated in FIG. 10A through FIG. 10D are similar to the embodiment illustrated in FIG. 8A through FIG. 8C, the only difference being in the configuration of the aperture 26. As such, the construction of the mixer 10 illustrated in FIG. 10A through FIG. 10D are not described again for the sake of brevity of the present disclosure. Also, like elements in FIG. 8A through FIG. 8C and FIG. 10A through FIG. 10D are referenced by like numerals for the sake of simplicity. The aperture 26, in the present embodiment, has a circular shape. The circular shape of the aperture 26 allows an extension segment 28A of a cylindrical profile to be fitted into the aperture 26 for maneuvering the mixer 10.

Figure 11A:
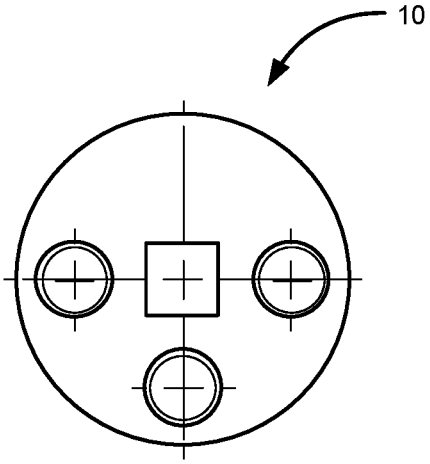
FIG. 11A illustrates a top view of mixer 10, in accordance with still another embodiment of the present invention.
Figure 11B:
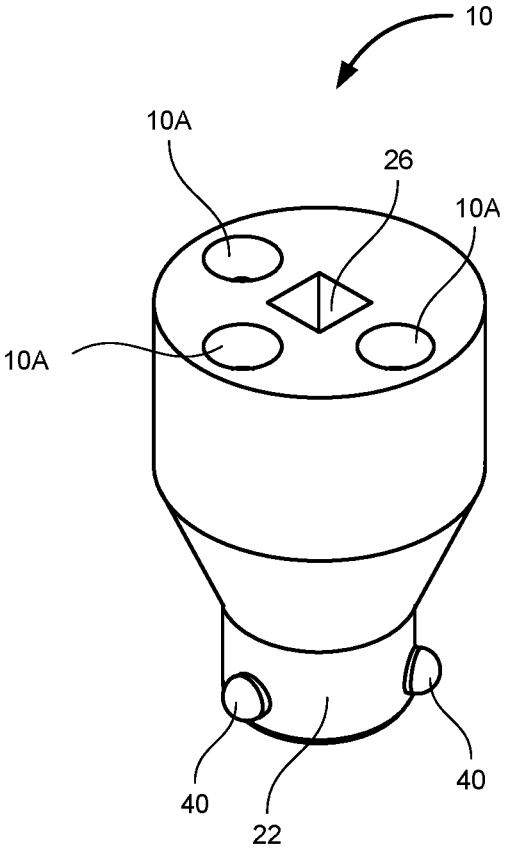
FIG. 11B illustrates an isometric of mixer 10, in accordance with still another embodiment of the present invention.
Figure 11C:
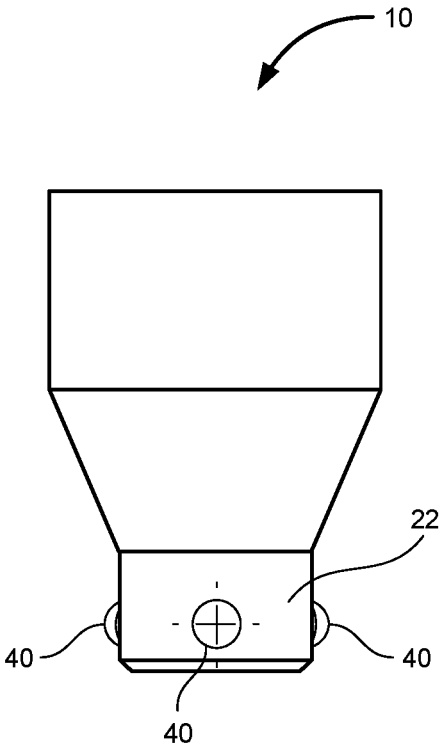
FIG. 11C illustrates a front view of mixer 10, in accordance with still another embodiment of the present invention.

FIG. 11A through FIG. 11C illustrate views of the mixer 10 in accordance with another embodiment of the present invention. This embodiment of the mixer illustrated in FIG. 11A through FIG. 11C are similar to the embodiment illustrated in FIG. 8A through FIG. 8C, the only difference being in the formations provided on the outer surface of the outlet 22 of the mixer. As such, the construction of the mixer 10 illustrated in FIG. 11A through FIG. 11C are not described again for the sake of brevity of the present disclosure. Also, like elements in FIG. 8A through FIG. 8C and FIG. 11A through FIG. 11C are referenced by like numerals for the sake of simplicity. The outlet 22 is provided with protrusions 40 on the outer surface of the outlet 22. More specifically, in this embodiment, the base 24 is provided with cavities for receiving protrusions 40 provided on the outlet 22 of the mixer 10, wherein the cavities and the protrusions 40 have complementary configuration for facilitating snap fit of the outlet 22 into the opening of the base 24.

Figure 12A:
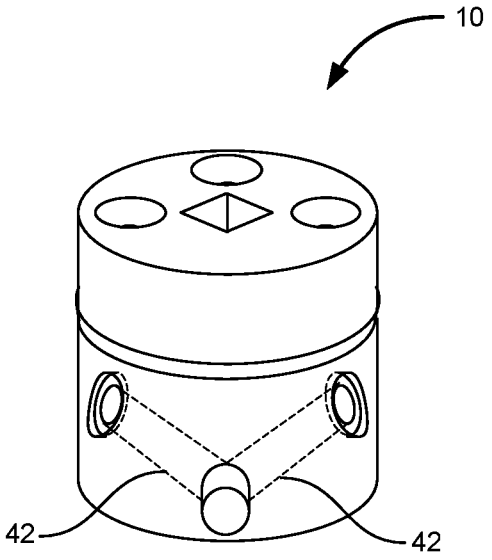
FIG. 12A illustrates a schematic view of mixer 10, in accordance with one embodiment of the present invention.
Figure 12B:
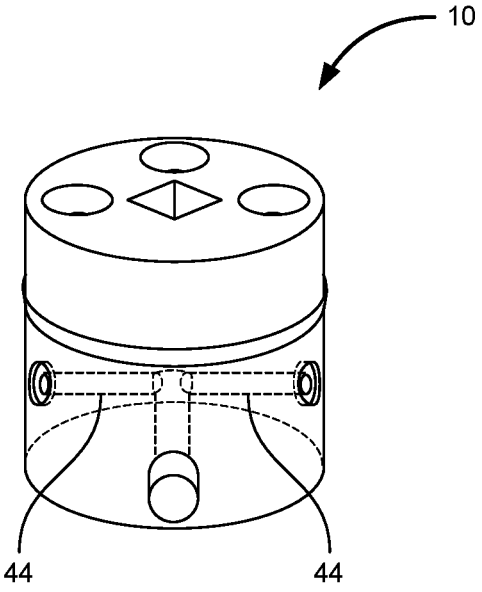
FIG. 12B illustrates a schematic view of mixer 10, in accordance with one other embodiment of the present invention.

FIG. 12A and FIG. 12B illustrate views of the mixer 10 in accordance with yet another embodiments. Referring to FIG. 12A, the mixer 10 further comprises a pair of inclined passages 42 extending from the outer periphery of the mixer 10 towards the central axis of the mixer 10. Referring to FIG. 12B, the mixer 10 further comprises a pair of horizontal passages 44 extending from the outer periphery of the mixer 10 towards the central axis of the mixer 10.

Figure 13A:
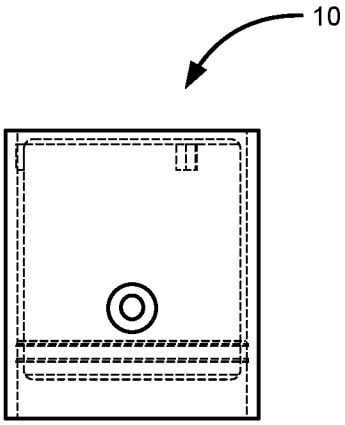
FIG. 13A illustrates a front view of mixer 10, in accordance with yet another embodiment of the present invention.
Figure 13B:
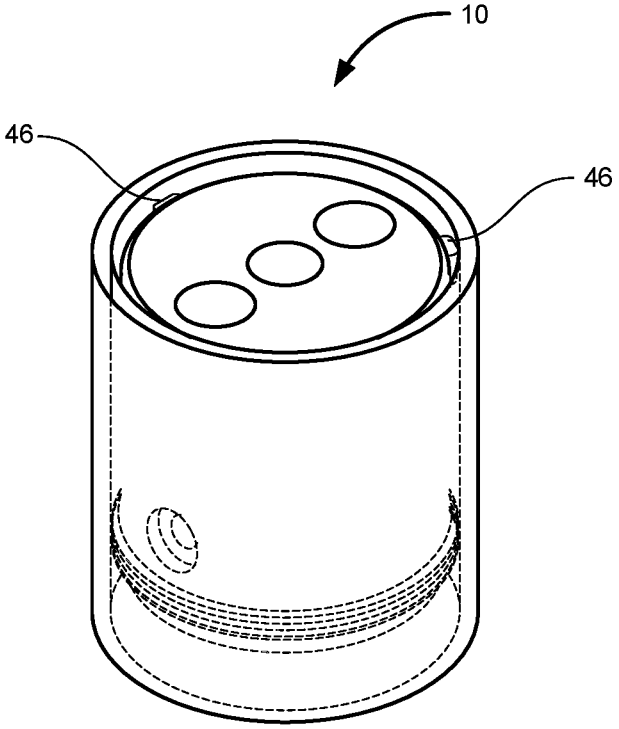
FIG. 13B illustrates an isometric view of mixer 10, in accordance with yet another embodiment of the present invention.
Figure 13C:
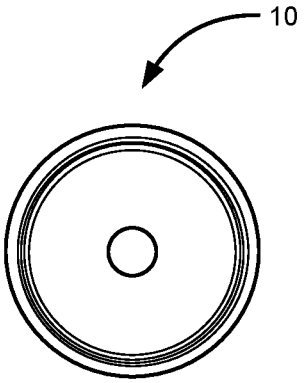
FIG. 13C illustrates a top view of mixer 10, in accordance with yet another embodiment of the present invention.

Referring to FIG. 13A through FIG. 13C, an embodiment of the mixer 10 is illustrated that comprises locating protrusions 46 provided on the periphery of the mixer for fitting the mixer 10 in a concentric tube. In an alternate embodiment, the mixer 10 is known as a Y-mixer and has a Y-shaped configuration. The mixer 10 can include a GPS device mounted thereon or housed therein that informs a user of the location of the mixer as it travels underground.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus for mixing at least two materials underground, the apparatus comprising:

a. at least two hoses in fluid communication with containers of the at least two materials, said at least two hoses each include a distal end that is inserted into a ground;

b. a mixer located at said distal end, the mixer having at least two apertures for receiving the at least two hoses, the mixer further defining a mixing chamber in fluid communication with the at least two apertures to receive at least two materials that enter said at least two apertures through said at least two hoses for facilitating mixing thereof in the mixing chamber; and c. a base that is configured to be fitted to an at least one outlet of the mixer, the base having an opening to securely receive the mixer.

2. The apparatus as claimed in claim 1, wherein the opening of the base is a threaded opening for receiving the at least one outlet of the mixer, wherein the outer surface of the at least one outlet is provided with thread formations complementary to that provided on the opening.

3. The apparatus as claimed in claim 1, wherein the opening of the base is provided with cavities for receiving protrusions provided on the at least one outlet of the mixer, wherein the cavities and the protrusions have complementary configuration for facilitating snap fit of the at least one outlet into the opening.

4. The apparatus as claimed in claim 1, further comprising an extension assembly, wherein the extension assembly comprises at least one extension segment, wherein one of the extension segments has a protrusion complementary to the at least two apertures provided on the operative top surface of the mixer.

5. The apparatus as claimed in claim 4, wherein one of the extension segments comprises a handle, wherein the handle facilitates providing manual drive to the extension assembly for fitting the mixer into the base.

6. The apparatus as claimed in claim 4, wherein the protrusion and the at least two apertures have a square profile.

7. The apparatus as claimed in claim 4, wherein the extension segments are configured to be snap fitted to each other.

8. The apparatus as claimed in claim 1, wherein the mixer comprises locating protrusion provided on the periphery of the mixer for fitting the mixer in a concentric tube.

9. The apparatus of claim 1 wherein said at least two materials to be mixed within said mixer include any combination of: polyurethane, sand, pressurized air, and pressurized water.

10. The apparatus of claim 9 wherein the mixer includes two outlets, a first outlet for said polyurethane and a second outlet for the rest of the at least two materials.

11. The apparatus of claim 1 wherein said at least two hoses are mounted to said mixer through said at least two apertures using a quick connector or screwed on.

12. The apparatus of claim 1 including a top bushing and a bottom bushing each having at least one passage opening adapted to have said at least two hoses pass through and be guided as said at least two hoses travel underground.

13. The apparatus of claim 1, wherein the number of at least two apertures corresponds with the number of at least two hoses.

* * * * *